US009944494B2

(12) United States Patent
Alasentie et al.

(10) Patent No.: US 9,944,494 B2
(45) Date of Patent: Apr. 17, 2018

(54) TRAVELLING CABLE OF AN ELEVATOR, AND AN ELEVATOR

(71) Applicant: KONE CORPORATION, Helsinki (FI)

(72) Inventors: Pentti Alasentie, Espoo (FI); Petri Kere, Helsinki (FI); Mikko Puranen, Rihimäki (FI)

(73) Assignee: KONE CORPORATION, Helsinki (FI)

( * ) Notice: Subject to any disclaimer, the term of this patent is extended or adjusted under 35 U.S.C. 154(b) by 311 days.

(21) Appl. No.: 14/455,290

(22) Filed: Aug. 8, 2014

(65) Prior Publication Data

US 2014/0345978 A1 Nov. 27, 2014

Related U.S. Application Data

(63) Continuation of application No. PCT/FI2013/050306, filed on Mar. 19, 2013.

(30) Foreign Application Priority Data

Mar. 22, 2012 (FI) ..... 20125318

(51) Int. Cl.
*B66B 7/06* (2006.01)
*B66B 11/08* (2006.01)
(Continued)

(52) U.S. Cl.
CPC ..... *B66B 7/064* (2013.01); *B66B 7/1238* (2013.01); *B66B 9/00* (2013.01); *D07B 1/02* (2013.01);
(Continued)

(58) Field of Classification Search
CPC ..... H01B 7/08; B66B 7/064
See application file for complete search history.

(56) References Cited

U.S. PATENT DOCUMENTS 4,227,041 A 10/1980 Den et al.
4,445,593 A 5/1984 Coleman et al.
(Continued)

FOREIGN PATENT DOCUMENTS

CN 102124158 A 7/2011
DE 10 2009 006 063 A1 7/2010
(Continued)

OTHER PUBLICATIONS

EPO, Machine Translation, JP 2010102851 A, Jul. 23, 2016, pp. 1-11.*
(Continued)

*Primary Examiner* — William A. Rivera
*Assistant Examiner* — Stefan Kruer
(74) *Attorney, Agent, or Firm* — Birch, Stewart, Kolasch & Birch, LLP

(57) ABSTRACT

A travelling cable of an elevator, more particularly of a passenger transport elevator and/or freight transport elevator, includes a protective envelope, conductors for transmitting electrical energy and data between the elevator car and the elevator hoistway, and one or more load-bearing bearer parts of essentially the length of the travelling cable for fixing the travelling cable at its first end to the elevator car and at its second end to the elevator hoistway, and which bearer part includes glass-fiber reinforcements and/or aramid-fiber reinforcements and/or carbon-fiber reinforcements and/or polybenzoxazole-fiber reinforcements and/or polyethylene-fiber reinforcements and/or nylon-fiber reinforcements in a polymer matrix material. An elevator includes the travelling cable.

16 Claims, 2 Drawing Sheets

(51) Int. Cl.

| | |
|---|---|
| ***B66B 7/12*** | (2006.01) |
| ***D07B 1/14*** | (2006.01) |
| ***D07B 1/10*** | (2006.01) |
| ***D07B 1/04*** | (2006.01) |
| ***D07B 1/02*** | (2006.01) |
| ***D07B 1/16*** | (2006.01) |
| ***B66B 9/00*** | (2006.01) |
| ***H01B 7/18*** | (2006.01) |
| ***H01B 9/00*** | (2006.01) |
| ***H01B 11/22*** | (2006.01) |
| *D07B 1/22* | (2006.01) |

(52) U.S. Cl.

CPC ..... *D07B 1/025* (2013.01); *D07B 1/145* (2013.01); *D07B 1/147* (2013.01); *D07B 1/162* (2013.01); *D07B 1/165* (2013.01); *H01B 7/182* (2013.01); *H01B 9/003* (2013.01); *H01B 11/22* (2013.01); *D07B 1/22* (2013.01); *D07B 2201/2096* (2013.01); *D07B 2205/205* (2013.01); *D07B 2205/2042* (2013.01); *D07B 2205/2046* (2013.01); *D07B 2205/2096* (2013.01); *D07B 2205/3003* (2013.01); *D07B 2205/3007* (2013.01); *D07B 2501/2007* (2013.01)

(56) References Cited

U.S. PATENT DOCUMENTS

| | | | | |
|---|---|---|---|---|
| 4,861,947 | A * | 8/1989 | Altermatt | H01B 7/182 174/113 C |
| 5,182,779 | A * | 1/1993 | D'Agostino | D07B 1/145 385/13 |
| 6,289,742 | B1 | 9/2001 | De Angelis | |
| 6,608,256 | B2 * | 8/2003 | Suzuki | H01B 3/423 174/110 SR |
| 7,154,081 | B1 * | 12/2006 | Friedersdorf | G01B 11/18 250/227.14 |
| 7,426,822 | B2 | 9/2008 | Vancompernolle et al. | |
| 2005/0226584 | A1 * | 10/2005 | Williams | D04C 1/02 385/130 |
| 2005/0252678 | A1 * | 11/2005 | Lee | H01B 7/0009 174/117 F |
| 2011/0100759 | A1 | 5/2011 | Yu et al. | |
| 2011/0259677 | A1 * | 10/2011 | Dudde | B66B 7/062 187/411 |

FOREIGN PATENT DOCUMENTS

| | | | | |
|---|---|---|---|---|
| GB | 2329722 | A | 3/1999 | |
| JP | 4-315702 | A | 11/1992 | |
| JP | 05298937 | A * | 11/1993 | |
| JP | 2001-302135 | A | 10/2001 | |
| JP | 2002-348067 | A | 12/2002 | |
| JP | 2010-102851 | A | 5/2010 | |
| WO | WO 2009090299 | A1 * | 7/2009 | B66B 7/062 |
| WO | WO 2011/135174 | A1 | 11/2011 | |

OTHER PUBLICATIONS

AIPN, Machine Tranlsation, JP05-0298937 A, Jul. 25, 2017, pp. 1-10.*

* cited by examiner

TRAVELLING CABLE OF AN ELEVATOR, AND AN ELEVATOR

CROSS REFERENCE TO RELATED APPLICATIONS

This application is a Continuation of PCT International Application No. PCT/FI2013/050306, filed on Mar. 19, 2013, which claims priority 35 U.S.C. 119(a) to Patent Application No. 20125318, filed in Finland on Mar. 22, 2013, all of which are hereby expressly incorporated by reference into the present application.

FIELD OF THE INVENTION

The object of the invention is a travelling cable of an elevator as defined in the preamble of claim 1, and an elevator as defined in the preamble of claim 13.

BACKGROUND OF THE INVENTION

It is advantageous to manufacture the ropes of lifting devices, more particularly the hoisting ropes and suspension ropes of passenger transport and freight transport elevators, to be of a composite structure. When basing the longitudinal load-bearing capability of ropes on non-metallic material, more particularly on non-metallic reinforcing fibers, the ropes can be lightened and as a result of the roping being lightweight the energy efficiency of the elevator can be improved. By forming the rope to be composite-structured and belt-type, considerable savings can be achieved even though the inexpensive metal material conventionally used in the ropes of an elevator is replaced with more expensive material.

A travelling cable is fixed to the car of a passenger transport elevator and/or freight transport elevator, via which travelling cable the elevator car is in connection with the elevator control center. The travelling cable is generally round in shape or is a flat cable and comprises electrical conductors and a load-carrying bearer surrounded by a protective envelope. The travelling cable is used for power transmission and with it the necessary electrical energy is supplied to the elevator car and with it data is transmitted between the signaling devices of the elevator car, such as car call pushbuttons, communication devices and displays, and also the control system of the elevator. The load-bearing part of the travelling cable is according to prior art a steel rope bearer, typically a 6-strand or 8-strand steel rope, which comprises a steel core and strands passing around it. The travelling cable is typically fixed at the first end of the rope bearer to the elevator car and at the second end to the elevator hoistway.

The travelling cable can also be used fully or partly as compensation to compensate the moment of imbalance caused by the hoisting ropes, which moment of imbalance is created when the car moves. When using composite-structured lightweight hoisting ropes and suspension ropes, the mass per meter of travelling cables implemented with steel rope bearers is too great for implementing optimal compensation. Travelling cables comprising steel rope bearers are too heavy for use with lightweight composite ropes, in which case overcompensation of the ropes becomes a problem.

Additionally, a problem particularly in high-rise buildings and in the high-speed elevators used in them is that at high speeds vortices occur in the elevator hoistway owing to the air resistance of the elevator car, which vortices produce lateral movement in the travelling cable of the elevator and more particularly in the bottom loop of said cable. Sideways movement in the lateral direction of the travelling cable in high-rise buildings is also caused by movements of the elevator car itself and from swaying of the building caused mainly by wind. This type of lateral swaying is undesirable, because it increases the stressing of the travelling cable and produces noise and vibration or other discomfort to passengers of the elevator car. In addition, large lateral movement might cause the travelling cable to strike structures of the elevator hoistway, damaging hoistway devices or itself getting caught on them. In this case one consequence can even be an emergency stop of the elevator. Known in the art are sway damping solutions wherein the travelling cable of the elevator is guided with various guides to travel along a certain path or a separate damping means is used in the bottom loop of the travelling cable.

GENERAL DESCRIPTION OF THE INVENTION

The aim of the invention is to eliminate the aforementioned drawbacks of prior-art solutions. The aim of the invention is to improve the structure of the travelling cable of a lifting device, more particularly of a passenger transport elevator and/or freight transport elevator, and to enable optimal compensation of composite-structured hoisting ropes and suspension ropes of the elevator by the aid of the travelling cable.

The aim of the invention is to achieve one or more of the following advantages, among others:

- A travelling cable and an elevator are achieved, the mass per meter of which travelling cable is less than before.
- A travelling cable and an elevator are achieved, the stiffness properties and strength properties of the bearer parts of the travelling cable of which are optimal with respect to the application location.
- An elevator is achieved, the mass of the parts of which that move along with the car is lower than before.
- An elevator is achieved, the composite-structured hoisting ropes and suspension ropes of which have optimal compensation.
- A travelling cable and an elevator are achieved, the size of the bottom loop of the travelling cable of which is optimal and the sway damping properties of which are better.
- A travelling cable and an elevator are achieved, the condition of the bearers of the travelling cable of which can be monitored with the same condition monitoring method as the hoisting ropes and suspension ropes.
- A travelling cable and an elevator are achieved, in connection with the fabrication of the bearers of the travelling cable of which sensors for condition monitoring can be integrated into the bearers.

The invention is based on the concept that a travelling cable of a lifting device, more particularly of a passenger transport elevator and/or freight transport elevator, comprises one or more load-bearing bearer parts, the cross-section of which is essentially round or of rectangular shape and which bearer part comprises glass fiber reinforcements and/or aramid fiber reinforcements and/or carbon fiber reinforcements and/or polybenzoxazole fiber reinforcements and/or polyethylene fiber reinforcements and/or nylon fiber reinforcements in a polymer matrix material.

In this way the mechanical properties of the bearer part and of the travelling cable can be optimized according to the application location and the structure becomes strong in the longitudinal direction of the travelling cable.

Preferably the size of the bottom loop of the travelling cable can be reduced, the advantage of which is even easier layout design. Another advantage is better ride comfort and safety, because a stable travelling cable does not catch on the hoistway structures in the elevator hoistway and therefore does not cause hazardous or damaging situations. A further advantage is the adjustability of the damping of the travelling cable by adjusting the stiffness properties of the bearer part. For example, the width of the cross-section of the bearer part of the travelling cable can be greater than the thickness. Thus the transverse stiffness of the bearer part can be adjusted, in which case the optimal damping of lateral sways in different structural solutions is possible.

Preferably the maximum diameter of the cross-section of the bearer part of the travelling cable is at least 5 mm or more, preferably at least 10 mm, or even 15 mm or more, or even 20 mm or more, or even 25 mm or more or even 30 mm or more. In this way good load-bearing capability is achieved with a small bending radius. This can be implemented preferably with the fiber-reinforced composite material presented in this patent application.

Preferably the bearer part of the travelling cable comprises glass-fiber reinforcements, more preferably aramid-fiber reinforcements or carbon-fiber reinforcements. Thus the specific stiffness and specific strength of the reinforcements are better than of metal fibers.

Preferably the bearer part of the travelling cable comprises polymer fiber reinforcements, e.g. polybenzoxazole fiber reinforcements, or polyethylene fiber reinforcements, such as UHMWPE fiber reinforcements, or nylon fiber reinforcements. Thus all the reinforcements are more lightweight than metal fibers.

In one embodiment the bearer part of the travelling cable comprises different reinforcements, preferably e.g. carbon fiber reinforcements and polybenzoxazole fiber reinforcements in the same structure of the load-bearing part. Thus the load-bearing part of the rope can be optimized to be that desired in terms of its mechanical properties and costs.

Preferably one or more optical fibers and/or fiber bundles are arranged in connection with manufacture inside and/or on the surface of the bearer part of the travelling cable for arranging monitoring of the condition of the rope or for data transfer.

Preferably the proportion by volume of the reinforcements of the bearer part of the travelling cable is at least 50 percent by volume reinforcing fibers in the load-bearing part. In this way the longitudinal mechanical properties of the aforementioned bearer part are adequate.

Preferably the proportion of the reinforcements of the bearer part of the travelling cable is at least 50 percent by weight reinforcing fibers in the load-bearing part. In this way the longitudinal mechanical properties of the aforementioned bearer part are adequate.

Preferably at least 65 percent of the surface area of the cross-section of the bearer part of the travelling cable is of reinforcing fibers. In this way the longitudinal mechanical properties of the aforementioned bearer part are adequate.

In one embodiment the bearer part of the travelling cable comprises inside it and/or on its surface one or more optical fibers, most preferably of all a fiber bundle or fiber winding, which is disposed essentially inside and/or in the proximity of the surface of the aforementioned bearer part as viewed in the thickness direction of the bearer part.

Preferably the optical fibers to be used for condition monitoring of the bearer part of the travelling cable and for measuring purposes comprise a number of optical fibers needed for measurements and also, in addition to them, fibers to be used for data transfer.

Preferably over 60 percent of the surface area of the cross-section of the bearer part of the travelling cable is of the aforementioned reinforcing fiber and optical fiber, preferably such that 45 percent-85 percent is of the aforementioned reinforcing fiber and optical fiber, more preferably such that 60 percent-75 percent is of the aforementioned reinforcing fiber and optical fiber, most preferably such that approx. 59 percent of the surface area is of the reinforcing fiber and at most approx. 1 percent is of optical fiber and approx. 40 percent is of matrix material.

In one embodiment an optical fiber, which functions as an optical Fabry-Pérot-type sensor, is integrated into the bearer part of the travelling cable.

In one embodiment a single-piece optical fiber, comprising Bragg gratings is integrated into the bearer part of the travelling cable, i.e. the so-called Fiber Bragg Grating FBG method is applied in the condition monitoring of the rope.

In one embodiment an optical fiber, which is used as a sensor functioning on the Time-Of-Flight TOF principle, is integrated into the bearer part of the travelling cable.

In one embodiment an optical fiber, which is used as a sensor based on Brillouin spectrum measurement, is integrated into the bearer part of the travelling cable.

Preferably the optical fibers and/or fiber bundles comprised in the bearer part of the travelling cable are essentially translucent to LED light or laser light. Thus the condition of the aforementioned bearer part can be monitored by monitoring changes in one of its optical properties.

In one embodiment the condition of the bearer part of the travelling cable is monitored by measuring changes in an electrical property of the aforementioned bearer part. The electrical resistance or capacitance of a bearer part comprising reinforcing fibers, more particularly carbon-fiber reinforcements, changes when the condition of the composite structure of the bearer part deteriorates, e.g. when reinforcing fibers break, and when the strain increases.

Preferably the density of the reinforcing fibers of the bearer part of the travelling cable is less than 4000 kg/m3 and/or the tensile strength of the aforementioned reinforcing fibers is over 1500 N/mm2. Preferably the specific strength of the reinforcing fibers of the bearer part of the travelling cable in tension is over 500 (MPa/g/cm3). One advantage is that the fibers are lightweight, and not many of them are needed because they are strong.

Preferably the bearer part of the travelling cable is an unbroken elongated rod-like piece.

Preferably the bearer part of the travelling cable is essentially unidirectional with the longitudinal direction of the travelling cable.

Preferably the structure of the bearer part of the travelling cable continues essentially the same for the whole length of the travelling cable.

Preferably the individual reinforcing fibers of the bearer part of the travelling cable are homogeneously distributed into the aforementioned matrix material.

Preferably the reinforcing fibers of the bearer part of the travelling cable are bound into an unbroken load-bearing part with the aforementioned polymer matrix material in the manufacturing phase by disposing the reinforcing fibers in the polymer matrix material.

Preferably the reinforcing fibers of the bearer part of the travelling cable and the one or more optical fibers and/or fiber bundles are bound into an unbroken load-bearing part with the aforementioned polymer matrix material in the manufacturing phase by disposing the reinforcing fibers and optical fibers in the polymer matrix material.

Preferably the bearer part of the travelling cable is composed of straight reinforcing fibers essentially unidirectional with the longitudinal direction of the travelling cable and of one or more optical fibers and/or fiber bundles, which are bound into an unbroken part with the polymer matrix material.

Preferably one or more optical fibers and/or fiber bundles is glued or laminated to the surface, or in the proximity of the surface of the bearer part of the travelling cable, in the longitudinal direction of the travelling cable.

Preferably essentially all the reinforcing fibers of the aforementioned load-bearing part of the bearer part of the travelling cable and the one or more optical fibers and/or fiber bundles are in the longitudinal direction of the travelling cable.

Preferably the matrix material of the bearer part of the travelling cable is of non-elastomer. More preferably the matrix material of the bearer part of the travelling cable comprises epoxy resin, polyester resin, phenolic resin or vinyl ester.

Preferably the modulus of elasticity E of the matrix material of the bearer part of the travelling cable is over 1.5 GPa, most preferably over 2 GPa, even more preferably in the range 2-10 GPa, most preferably of all in the range 2.5-4 GPa.

Preferably the bearer part of the travelling cable is composed of the aforementioned polymer matrix, of reinforcing fibers bound to each other by the polymer matrix and of one or more optical fibers and/or fiber bundles, and also possibly of a sizing around the fibers, and also possibly of additives mixed into the polymer matrix.

In one embodiment an optical fiber of the bearer part of the travelling cable also functions as a long vibration sensor. In the vibration measuring apparatus, single-mode fiber or multimode fiber is used as a sensor and a semiconductor laser as a light source. The detection of vibration is based on measuring the changes of a speckle diagram formed of bright and dark spots occurring at the second end (in the far field) of an optical fiber.

According to the invention the elevator comprises means for monitoring the condition of the optical fibers and/or fiber bundles of the bearer part of the travelling cable, which means monitor from the bearer part of the travelling cable preferably the condition of the aforementioned one or more optical fibers and/or fiber bundles.

Preferably with the aforementioned condition-monitoring means the condition of the bearer part or bearer parts of the travelling cable is monitored by monitoring the condition of the parts comprising one or more optical fibers and/or fiber bundles in one of the following ways:

- by measuring changes that have occurred in the time-of-flight of a light pulse in an optical fiber,
- by detecting changes in the spectrum and/or phase and/or wavelength of reflected, deflected or scattered light,
- by detecting visually or by the aid of a photodiode the amount of light travelling through a fiber,
- by comparing the values measured from different fibers and/or fiber bundles with each other and
- by observing the deviations between the measured values instead of the absolute values.

In this way changes in the strain of one or more bearer parts of the travelling cable, and thereby also the condition of the aforementioned bearer part, can be assessed.

The elevator according to the invention comprises an elevator car, a counterweight, suspension roping, which connects the aforementioned elevator car and counterweight to each other, and which suspension roping comprises one or more ropes, which comprise a load-bearing composite part, which comprises reinforcing fibers in a polymer matrix. The elevator car and the counterweight are arranged to be moved by exerting a vertical force on at least the elevator car or on the counterweight.

Preferably the elevator comprises a rope pulley in the proximity of the top end of the path of movement of the elevator car, while supported on which rope pulley the rope/ropes of the suspension roping support the elevator car and the counterweight, preferably with a 1:1 suspension or alternatively with a 2:1 suspension. Preferably the aforementioned rope pulley is a non-driven rope pulley. In this way the space of the large diverting pulley required by a stiff composite rope is free from the machine.

In one embodiment the suspension roping is connected to the elevator car and to the counterweight with a 1:1 suspension ratio and the hoisting roping is connected to the elevator car and to the counterweight with a 2:1 suspension ratio.

Preferably the suspension roping is connected to the elevator car and to the counterweight in such a way that when the elevator car moves upwards the counterweight moves downwards, and vice versa, and the suspension roping travels over the rope pulley that is supported in its position.

In one embodiment the hoisting machine is disposed in the proximity of the top end of the path of movement of the elevator car, in which case the aforementioned rope pulley is a driven traction sheave. Thus, if necessary, the space required by the bottom part of the elevator and by the elevator hoistway can be kept small.

In one embodiment the hoisting machine is disposed in the proximity of the bottom end of the path of movement of the elevator car. In this way the hoisting machine is very accessible in connection with installation and servicing. The hoisting machine is quick to install and it does not increase the size of the structure of the top parts of the elevator.

Preferably the hoisting machine is disposed in the elevator hoistway in the proximity of the bottom end of the path of movement of the elevator car. Thus a separate space is not needed for it. It can be supported on the base of the elevator hoistway or between the wall of the elevator hoistway and the path of movement of the elevator car, e.g. on the wall structures of the elevator hoistway. Preferably the hoisting machine is arranged to exert via the hoisting roping a downward-pulling force on the elevator car or on the counterweight. Thus exerting with the hoisting machine a vertically downward-pulling force on the elevator car or on the counterweight for acting on the force balance between them, and thereby for adjusting the movement of them, can be arranged.

The elevator is most preferably an elevator applicable to the transporting of people and/or of freight, which elevator is installed in a building, to travel in a vertical direction, or at least in an essentially vertical direction, preferably on the basis of landing calls and/or car calls. The elevator car preferably has an interior space, which is most preferably suited to receive a passenger or a number of passengers. The elevator preferably comprises at least two, preferably more, floor landings to be served.

Some inventive embodiments are also presented in the descriptive section and in the drawings of the present application. The inventive content of the application can also be defined differently than in the claims presented below.

The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments.

BRIEF DESCRIPTION OF THE FIGURES

The invention will now be described in more detail in connection with its preferred embodiments, with reference to the attached drawings, wherein.

DETAILED DESCRIPTION OF THE INVENTION

Figure 1:
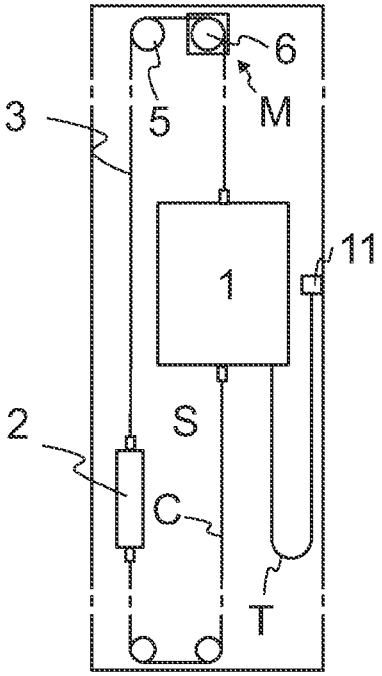
FIG. 1 presents an elevator according to a first embodiment of the invention.
Figure 2:
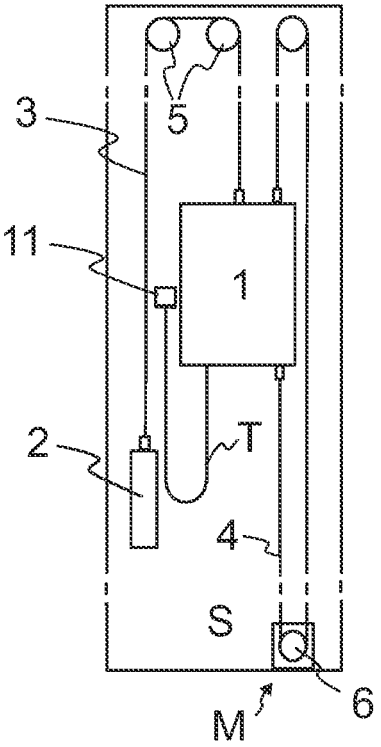
FIG. 2 presents an elevator according to a second embodiment of the invention.

FIGS. 1 and 2 present an elevator according to the invention, which comprises an elevator car 1, a counterweight 2 and suspension roping 3, the ropes of which connect the aforementioned elevator car 1 and aforementioned counterweight 2 to each other. The elevator car 1 and the counterweight 2 are arranged to be moved by exerting a vertical force on at least the elevator car 1 or on the counterweight 2 by the aid of the means M, 6, 3, 4. The suspension roping 3 comprises one or more ropes, which comprise a load-bearing composite part, which comprises reinforcing fibers in a polymer matrix. The elevator is preferably a passenger transport elevator and/or freight transport elevator, which is installed to travel in an elevator hoistway S in a building.

In the embodiment presented in FIG. 1, the means for exerting a force on at least the elevator car 1 or counterweight 2 comprise suspension roping 3, which is connected to the elevator car and/or to the counterweight, and a hoisting machine M, which comprises means for moving the suspension roping 3, which means preferably comprise a rotating device, e.g. a motor, and a traction means 6, preferably a traction sheave, to be rotated. The hoisting machine M is disposed in the proximity of the top end of the path of movement of the elevator car 1. Thus the hoisting machine M is, via the suspension roping 3, in force transmission connection with the elevator car 1 and with the counterweight 2, more particularly the hoisting machine M is arranged to exert via the suspension roping 3 an upward-pulling force on the elevator car 1 or on the counterweight 2. A compensating rope C is fixed to the bottom part of the elevator car 1 and of the counterweight 2 to compensate the moment of imbalance caused by the suspension ropes.

In the embodiments presented in FIG. 2, the means for exerting a force on at least the elevator car 1 or counterweight 2 comprise hoisting roping 4, which is connected to the elevator car and/or to the counterweight, and a hoisting machine M, which comprises means for moving the hoisting roping 4, which means preferably comprise a rotating device, e.g. a motor, and a traction means 6, preferably a traction sheave, to be rotated. The hoisting machine M is disposed in the proximity of the bottom end of the path of movement of the elevator car 1. Thus the hoisting machine M is, via the hoisting roping 4, in force transmission connection with the elevator car 1 and with the counterweight 2, more particularly the hoisting machine M is arranged to exert via the hoisting roping 6 a downward-pulling force on the elevator car 1 or on the counterweight 2. Thus the rope of the suspension roping 3 does not need to transmit on a normal run of the elevator the longitudinal forces of the rope via the outer surface of the rope, and shearing forces in the direction of the surface are not exerted on the bearing composite part or on a coating possibly connected to it.

The ropes of the suspension roping 3 can be suspended by bending around a rope pulley, which rope pulley does not need to be a driven rope pulley. As presented the elevator comprises a rope pulley 5 or rope pulleys in the proximity of the top end and/or the bottom end of the path of movement of the elevator car 1. For example, while supported on the rope pulley 5 the rope or ropes of the suspension roping 3 support the elevator car 1 and the counterweight 2. In the embodiments presented this is implemented with a 1:1 suspension, in which case the ropes of the suspension roping 3 are fixed at their first end to the elevator car 1 and at their second end to the counterweight 2. The suspension ratio can, however, be another, e.g. 2:1, but a 1:1 ratio is advantageous because, when the rope structure comprises a composite part in the manner specified, making a large number of bends is not advantageous owing to the space taken by the bends. Preferably the rope pulleys are non-driven rope pulleys, thus also the top parts of the elevator can be formed to be spacious. The rope pulleys are in the elevator hoistway S, in which case a separate machine room is not needed.

The hoisting roping 4 can be different in its cross-section and/or in its material to the suspension roping 3. The structure of the ropes of the hoisting roping 4 can be optimized e.g. from the viewpoint of shearing force in the direction of the rope and of friction, whereas the structure of the ropes of the suspension roping 3 can be optimized from the viewpoint of the tensile strength and stiffness and lightness of the rope. The suspension roping 3 and the hoisting roping 4 can comprise one or more ropes, which comprise one or more force-transmitting parts of composite structure.

The travelling cable T, e.g. cable of round cross-sectional shape or flat cable, intended for the electricity supply of the elevator car 1 and/or for data traffic is fixed at its first end to the elevator car 1, e.g. to the bottom part of the elevator car 1, and at its second end to a connection point on the wall of the elevator hoistway S, which connection point is typically at the point of the midpoint or above the midpoint of the height direction of the elevator hoistway. From the elevator car 1 the travelling cable leaves at first downwards and then turns upwards towards its fixing point of the second end forming a bottom loop in its bottom part, which bottom loop hangs freely in the elevator hoistway and moves in the hoistway S upwards or downwards along with the movement of the elevator car 1.

Figure 3:
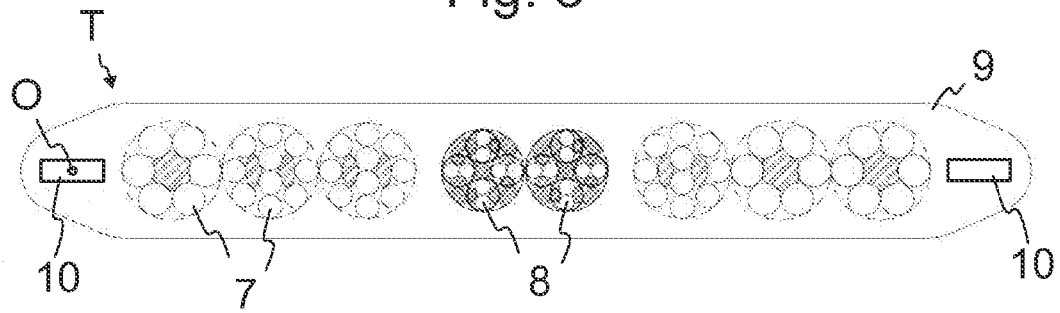
FIG. 3 presents a cross-section of a travelling cable according to a first embodiment of the invention.
Figure 4:
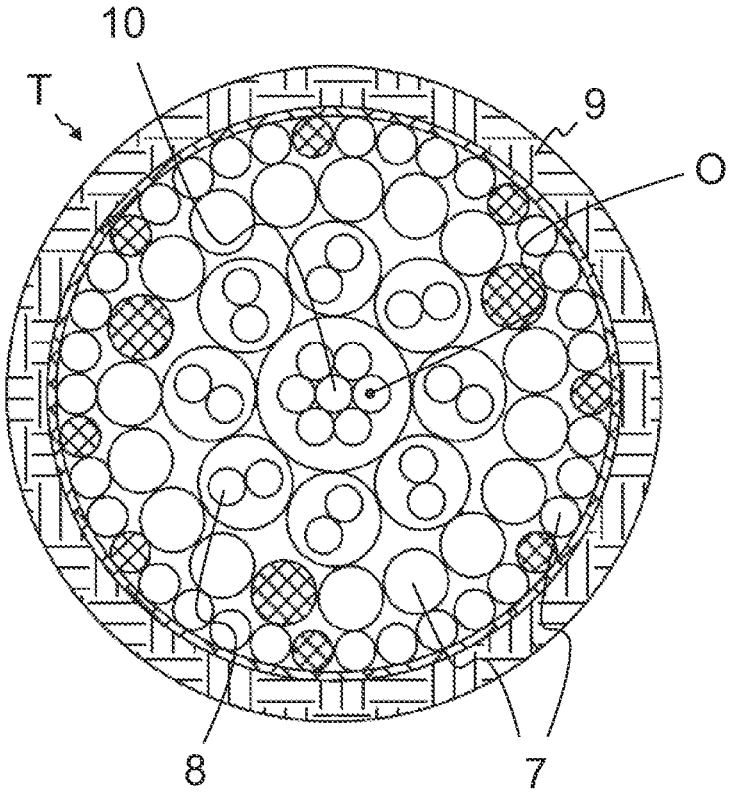
FIG. 4 presents a cross-section of a travelling cable according to a second embodiment of the invention.

FIGS. 3 and 4 present cross-sections of preferred embodiments of the travelling cable T of an elevator according to the invention. As stated earlier, the travelling cable T of the elevator comprises electricity conductors for power transmission and with the travelling cable the necessary electrical energy is supplied to the elevator car 1 and with it data is transmitted between the signaling devices of the elevator car 1, such as between car call pushbuttons, communication devices and displays, and also the control system of the elevator. The embodiment of FIG. 1 presents a cross-sectionally flat travelling cable of an elevator, which travelling cable comprises composite-structured bearer parts 10 according to the invention as well as electrical conductors 7 and twisted-pair cables 8 side-by-side between the bearer parts 10 preferably inside a protective envelope 9 fabricated from PVC plastic. The bearer parts 10 according to the invention, which comprise reinforcing fibers, preferably glass-fiber reinforcements, more preferably aramid-fiber reinforcements or carbon-fiber reinforcements in a polymer matrix material, which is preferably resin, e.g. epoxy resin, polyester resin, phenolic resin or vinyl ester. Preferably the bearer part of the travelling cable can also comprise polymer fiber reinforcements, e.g. polybenzoxazole fiber reinforcements, or polyethylene fiber reinforcements, such as UHMWPE fiber reinforcements, or nylon fiber reinforcements in a polymer matrix material. Thus the specific stiffness and specific strength of the fiber-reinforced bearer part are better than a steel rope bearer. In addition, the stiffness properties of the fiber-reinforced bearer part and the diameter of the bottom loop of the travelling cable can be tailored to that desired by changing the geometry and the diameter or thickness of the cross-section of the bearer part.

The width of the aforementioned bearer part 10 is preferably greater than the thickness, e.g. the cross-section of the bearer part 10 can be of rectangular shape, as is presented in FIG. 3, or round. In this way the stiffness of the bearer part in the transverse direction of the travelling cable is greater for reducing lateral sways. The aforementioned bearer part can also be a fiber rope braided from straight reinforcing fibers or reinforcing fiber bundles. The bearer part can also comprise a core material, which is of a different material than the fiber-reinforced surface material, or which is hollow in the center. In this way a more flexible bearer part is obtained with a smaller mass per meter without, however, losing the good strength properties of the bearer part in the longitudinal direction of the travelling cable.

The aforementioned bearer part 10 can be fabricated e.g. in pultrusion by pulling reinforcements wetted with resin or prepreg reinforcements through a heated nozzle acting as a mould, in which the bearer part 10 receives its shape and the resin hardens. In this way good strength properties in the longitudinal direction of the travelling cable are obtained for the bearer part 10. The reinforcements can also be partly or fully wound around a preform functioning as the core material. In this way the stiffness properties of the bearer part 10 can be further adjusted by adjusting the winding angle of the reinforcements. The core material is preferably e.g. of PVC foam or urethane foam. Pultrusion is a continuous, highly-automated profile manufacturing method, which reaches a high production speed, preferably a production speed as high as 0.5-2 m/min, i.e. pultrusion is particularly suited to the manufacture of large series. Pultrusion products characteristically have a high reinforcement content and longitudinal alignment of the reinforcements. Owing to this, the axial mechanical properties are also high. The reinforcements are typically rover-type reinforcements.

The bearer part 10 of the travelling cable T is a flexible member elongated in the longitudinal direction of the travelling cable T for receiving a load in essentially the longitudinal direction of the travelling cable T. The aforementioned bearer part is able to bear a significant part of the load exerted on the travelling cable in question, e.g. tensile stress in the longitudinal direction of the travelling cable caused by moving the elevator car 1 and the counterweight 2 according to the embodiment of FIG. 1. The conductors 7 and twisted-pair cables 8 of the travelling cable are connected at their first end to a connection point of the bottom part of the elevator car 1 in such a way that the bearer parts 10 of the travelling cable T are fixed into the fixing element on the bottom part of the elevator car 1, which fixing element bears the loads exerted from the travelling cable T. The conductors 7 and twisted-pair cables 8 of the travelling cable are connected at their second end to a connection point 11 on the wall of the elevator hoistway S and the travelling cable is suspended on the connection point 11 supported by the load-bearing bearer terminal fixed to the ends of the bearer parts 10.

According to the invention the width of the aforementioned bearer part 10 is preferably greater than the thickness. The width-thickness ratio of the bearer part 10 is preferably at least 2 or more, more preferably at least 4, or even 5 or more, or even 6 or more, or even 7 or more or even 8 or more.

According to one embodiment of the invention, presented in FIG. 3, the travelling cable T comprises two bearer parts 10, which are preferably of glass-fiber reinforced and/or aramid-fiber reinforced and/or carbon-fiber reinforced and/or polybenzoxazole-fiber reinforced and/or polyethylene-fiber reinforced and/or nylon-fiber reinforced plastic composite, which comprises glass reinforcing fibers and/or aramid reinforcing fibers and/or carbon reinforcing fibers and/or polybenzoxazole reinforcing fibers and/or polyethylene reinforcing fibers and/or nylon reinforcing fibers, most preferably carbon fibers, and also one or more optical fibers O, more preferably one or more fiber bundles, in a polymer matrix material, for monitoring the condition of the rope. An optical fiber or fiber bundle can be one continuous fiber or bundle disposed inside, or in the proximity of the surface of, the composite structure in such a way that the fiber goes inside the structure from a second end of the travelling cable, turns back at the first end of the travelling cable and comes out of the structure again from the second end of the travelling cable. A fiber and/or a fiber bundle can be wound, i.e. the fiber can have one or more turns inside, or on the surface of, the structure such that, however, only one fiber and/or fiber bundle is used for the measurement, and the aforementioned fiber and/or fiber bundle can go into and come out of the same end or different ends of the travelling cable. In this way one or more optical fibers and/or fiber bundles are integrated into the structure as sensor fibers and/or as reference fibers, the condition of which sensor fibers is monitored, e.g. by measuring the time-of-flight of a light pulse in the sensor fiber. The optical fiber and/or fiber bundle preferably comprises at least a sensor fiber, preferably also a reference fiber. The reference fiber can also be installed inside the envelope such that strain caused by the structure to be measured is not exerted on it. In FIG. 3 the optical fiber O is drawn in only one of the two bearers 10 of the travelling cable, but preferably the optical fiber is disposed according to the embodiment of the invention in both bearers 10, preferably in all the bearers, which are structurally similar.

The width of the aforementioned bearer part 10 according to the invention presented in FIG. 3 is preferably greater than the thickness. The aforementioned bearer part 10 can also comprise one or more grooves in the longitudinal and/or transverse direction of the rope on one or more of its wider sides, which aforementioned groove divides the bearer part 10 into parts in the longitudinal direction and/or in the transverse direction of the rope, for optimizing the longitudinal stiffness of the bearer part. The cross-section of the aforementioned bearer part 10 can also be a conic section in its shape.

According to the embodiment of the travelling cable T according to the invention, which embodiment is presented in FIG. 4 and is essentially round in cross-sectional shape, the aforementioned bearer part 10 comprises one or more bearer parts 10 in essentially the center part of the travelling cable, which bearer comprises the aforementioned reinforcing fibers in a polymer matrix material. The aforementioned bearer part 10 can also be a fiber rope braided from straight reinforcing fibers or reinforcing fiber bundles. The bearer part 10 can also comprise a core material, which is of a different material than the fiber-reinforced surface material, or which is hollow on the inside. According to the embodiment presented in FIG. 4, in essentially the center of the travelling cable is a bearer part 10, which is surrounded by six similar bearer parts that are round in cross-sectional shape. By changing the number of bearer parts, the diameter, the material of the reinforcements and the material of a possible matrix material, the stiffness properties of the travelling cable and the size of the bottom loop can be adjusted to that desired. According to the embodiment of FIG. 4, one optical fiber O is drawn in a bearer part, but the bearer parts can also comprise a number of optical fibers. In this way measurement accuracy can, if necessary, be improved. A travelling cable can also comprise filler fibers, e.g. of jute, as well as insulations and a fabric layer between the protective envelope and the conductors for reducing the friction between them.

The condition of the bearer part 10 of the travelling cable of an elevator is monitored by monitoring the condition of the sensor fibers, and if it is detected that a part of a sensor fiber has broken or the condition of it has fallen to below a certain predefined level, a need to replace or overhaul the travelling cable is diagnosed and travelling cable replacement work or travelling cable maintenance work is started. The condition of the bearer part 10 can also be monitored by measuring the time-of-flight of a light pulse in the sensor fibers of the different parts and by comparing the times-of-flight of the light pulses with each other and when the difference between the times-of-flight of the light pulses increases to above a predefined level, a need to replace or overhaul the travelling cable is diagnosed and travelling cable replacement work or travelling cable maintenance work is started. The condition monitoring device can be arranged to initiate an alarm if the time-of-flight of the light pulse does not fall within the desired value range or differs sufficiently from the measured values of the time-of-flight of the light pulse of other sensors being measured. The time-of-flight of the light pulse changes when a property that depends on the condition of a load-bearing part of the travelling cable, such as strain or displacement, changes. For example, owing to the breaking of reinforcing fibers the time-of-flight of the light pulse changes, from which change it can be deduced that the bearer part 10 is in poor condition.

Preferably the means for monitoring the condition of the bearer part 10 comprises a condition monitoring device connected to the sensor fibers and to the reference fibers of the bearer part 10, which device comprises means, such as e.g. a computer comprising a laser transmitter, receiver, timing discriminator, a circuit measuring a time interval, a programmable logic circuit and a processor. The aforementioned means comprise one or more sensors, each of which sensors comprises e.g. reflectors, and a processor, which when they detect a change, e.g. in the time-of-flight of the light pulse in the sensor fiber, raise an alarm about excessive wear of the bearer part 10.

The property to be observed can also be e.g. a change in the amount of light travelling through the bearer part 10. In this case light is fed into an optical fiber with a laser transmitter or with a LED transmitter from one end and the passage of the light through the bearer part 10 is assessed visually or by the aid of a photodiode at the other end of the fiber. The condition of the bearer part 10 is assessed as having deteriorated when the amount of light travelling through the bearer part 10 clearly decreases.

In one embodiment of the invention an optical fiber functions as an optical Fabry-Pérot-type sensor. A Fabry-Perot interferometer FPI comprises two reflective surfaces, or two parallel highly reflective dichroic mirrors, at the end of the fiber. When it hits the mirror a part of the light passes through and a part is reflected back. After the mirror the light passing through travels e.g. through air, after which it is reflected back from the second mirror. Some of the light has traveled a longer distance in a different material, which has caused changes in the properties of the light. Strain causes changes in e.g. the phase of the light. The light with changed properties interferes with the original light, after which the change is analyzed. After the lights have combined they end up in a receiver of a condition monitoring device of the elevator and in a signal-processing device. In the embodiment the strain of the fiber, and thus the condition of the bearer part 10, is assessed.

In one embodiment of the invention an optical fiber, comprising Bragg gratings is used, i.e. the so-called Fiber Bragg Grating FBG method is applied in the condition monitoring of the rope. Periodic grating structures are made in a single-mode fiber for the FBG sensor, which grating structures reflect a certain wavelength of the light corresponding to the grating back. When light is conducted into the fiber, the wavelength of the light corresponding to the grating is reflected back. When strain is exerted on the grating structure, the refractive index of the fiber changes. Changing of the refractive index affects the wavelength of the light being reflected back. By monitoring changes in wavelength, a change in the strain exerted on the grating can be ascertained, and thus also the condition of the bearer part 10. There can be tens or hundreds of gratings by the side of the same fiber.

In one embodiment of the invention a distributed sensor fiber based on Brillouin spectrometry is used as an optical fiber. Ordinary single-mode fiber or multimode fiber can be used as a sensor. The optical fiber functions as a distributed sensor, which can function as a sensor that is hundreds of meters long, which measures throughout its length and corresponds if necessary to thousands of point-form sensors. Backscattering of light occurs continuously as the light propagates in the fiber. This can be utilized by monitoring the strength of certain backscattering wavelengths. Brillouin scattering arises in the manufacturing phase in non-homogeneous points created in the fiber. By observing the wavelengths of the original and the scattered light signal the strain of the fiber, and thus the condition of the bearer part 10, is determined.

The effect of temperature on strain measurements can be eliminated by, inter alia, using a reference fiber as an aid, which reference fiber is installed such that strain caused by the structure to be measured is not exerted on it.

In one embodiment of the invention the bearer part 10 of the travelling cable comprises a part conducting electricity, preferably e.g. carbon-fiber reinforcement in a polymer matrix material. The condition monitoring arrangement comprises a condition monitoring device connected to the second end of the bearer part, near its fixing point, which is thus electrically conductive. The arrangement further comprises a conductor fixed to the electrically conductive, preferably metallic, first connection point of the bearer part 10, which conductor is also connected to the condition monitoring device. The condition monitoring device connects the bearer parts 10 and the conductors and is arranged to produce voltage between them. The condition monitoring device further comprises means for observing an electrical property of the circuit formed by the bearer parts 10 and the conductors. These means can comprise e.g. a sensor and a processor, which when they detect a change in an electrical property raise an alarm about excessive wear of the bearer part 10. The electrical property to be observed can be e.g. a change in the resistance or capacitance of the aforementioned circuit. The electrical property of a bearer part 10 comprising reinforcing fibers, more particularly carbon-fiber reinforcements, changes when the condition of the reinforcements deteriorates and when the strain of the bearer part increases.

Structurally the aforementioned bearer part 10 of the travelling cable is preferably a composite structure, preferably a non-metallic composite structure, which comprises reinforcing fibers in a polymer matrix material. The reinforcing fibers are essentially evenly distributed in the matrix material, which surrounds the individual reinforcing fibers and which is fixed to them. The matrix material fills the areas between individual reinforcing fibers and binds essentially all the reinforcing fibers that are inside the matrix material to each other as an unbroken solid binder agent. In this case abrasive movement between the reinforcing fibers and movement between the reinforcing fibers and the matrix material is prevented. A chemical bond exists between, preferably all, the individual reinforcing fibers and the matrix material, one advantage of which is cohesion of the structure. For reinforcing the chemical bond, a sizing obtained as a result of the surface treatment of the reinforcing fibers can be between the reinforcing fibers and the matrix material, in which case the aforementioned bond to the fiber is formed via the sizing in question.

The fact that the reinforcing fibers are in the polymer matrix material means that the individual reinforcing fibers and possible optical fibers are bound in the manufacturing phase to each other with the matrix material, e.g. with resin. With the method according to the invention, in pultrusion reinforcements wetted with resin or prepreg reinforcements are pulled through a heated nozzle acting as a mould, in which the piece receives its shape and the resin hardens. In this case there is resin in between the individual reinforcing fibers that are bound to each other. According to the invention, therefore, a large amount of reinforcing fibers in the longitudinal direction of the rope that are bound to each other are distributed in the matrix material, being also evenly distributed in the bearer part 10 of the travelling cable. The reinforcing fibers are preferably distributed essentially evenly in the matrix material such that the bearer part 10 of the travelling cable is as homogeneous as possible when viewed in the direction of the cross-section of the bearer part 10. In this way the reinforcement density does not vary greatly in the bearer part 10 of the travelling cable.

The reinforcing fibers and possible optical fibers together with the matrix material form an unbroken bearer part 10, inside which large shape deformations do not occur when the rope is bent. The individual fibers of the bearer part 10 of the travelling cable are mainly surrounded with matrix material, but contacts between fibers can occur in places, e.g. because of pores in the matrix material. If, however, it is desired to reduce the random occurrence of contact between fibers, the individual fibers can be surface treated before the binding of individual fibers to each other. In the invention the individual fibers of the bearer part 10 of the travelling cable can comprise the material of the matrix material around them such that the matrix material is immediately against the fiber, but the thin surface treatment material of the fiber, e.g. a primer arranged on the surface of the fiber in the manufacturing phase to improve chemical adhesion to the matrix material, can be in between. The matrix material can comprise a basic polymer and, as a supplement, additives for optimizing the properties of, or for hardening, the matrix material. The matrix material is preferably of non-elastomer. The most preferred matrix materials are epoxy resin, polyester resin, phenolic resin or vinyl ester. The modulus of elasticity E of the matrix material is preferably over 1.5 GPa, more preferably over 2 GPa, even more preferably in the range 2-10 GPa, most preferably of all in the range 2.5-4 GPa.

Preferably the aforementioned reinforcing fibers are non-metallic fibers, which have a high specific stiffness, i.e. ratio of the modulus of elasticity to density, and specific strength, i.e. ratio of strength to density. Preferably the specific strength of the reinforcing fibers of the bearer part 10 of the travelling cable in tension is over 500 (MPa/g/cm3) and the specific stiffness over 20 (GPa/g/cm3). Preferably the aforementioned reinforcing fibers are carbon fibers, glass fibers, aramid fibers or polymer fibers, e.g. polyethylene fibers, such as UHMWPE fibers, polybenzoxazole fibers or nylon fibers, which are all more lightweight than metal reinforcements. The reinforcing fibers of the bearer part 10 of the travelling cable can comprise one of these, e.g. just carbon fibers, or can be a combination of these fibers, e.g. carbon fibers and polybenzoxazole fibers, or can comprise at least one of these fibers. Most preferably the aforementioned reinforcing fibers are carbon fibers or polybenzoxazole fibers, which have a good specific stiffness and specific strength in tension and at the same time withstand very high temperatures. This is important in elevators because poor heat tolerance of the bearer part 10 of the travelling cable might be a safety risk.

It is obvious to the person skilled in the art that in developing the technology the basic concept of the invention can be implemented in many different ways. The invention and the embodiments of it are not therefore limited to the examples described above, but instead they may be varied within the scope of the claims.

The invention claimed is:

1. A travelling cable of an elevator, comprising:

a protective envelope;

conductors for transmitting electrical energy and data between an elevator car and an elevator hoistway; and load-bearing bearer parts of essentially the length of the travelling cable for fixing the travelling cable at a first end thereof to the elevator car and at a second end thereof to the elevator hoistway, wherein each bearer part is a composite structure and is composed of reinforcing fibers, wherein the reinforcing fibers are glass reinforcing fibers or aramid reinforcing fibers or carbon reinforcing fibers or polybenzoxazole reinforcing fibers or polyethylene reinforcing fibers or nylon reinforcing fibers, and wherein the reinforcing fibers are distributed in a polymer matrix material, wherein at least one bearer part of said bearer parts includes one or more optical fibers disposed inside, or essentially in a proximity of a surface of the composite structure of said at least one bearer part, wherein the composite structure of said at least one bearer part is completely non-metallic and wherein the reinforcing fibers of said at least one bearer part are straight and essentially unidirectional with a longitudinal direction of the traveling cable and are homogeneously distributed into the polymer matrix material of said at least one bearer part, wherein a plurality of said bearer parts are directly surrounded by a plurality of twisted-pair cables, and wherein the plurality of twisted-pair cables are directly surrounded by said conductors.

2. The travelling cable according to claim 1, wherein the polymer matrix material of each bearer part is a non-elastomer and the modulus of elasticity of the matrix material is at least 1.5 GPa.

3. The travelling cable according to claim 1, wherein the density of the reinforcing fibers of each bearer part is less than 4000 kg/m3 and/or the tensile strength of the reinforcing fibers is over 1500 N/mm2.

4. The travelling cable according to claim 1, wherein the reinforcing fibers of each bearer part are carbon fibers, glass fibers, aramid fibers or polymer fibers, or a number of different types of fibers.

5. The travelling cable according to claim 1, wherein the reinforcing fibers of each bearer part are a unidirectional reinforcement essentially in the longitudinal direction of the respective bearer part.

6. The travelling cable according to claim 1, wherein the one or more optical fibers extend inside the composite structure essentially from the first end of the travelling cable and come out essentially from the second end of the travelling cable, or makes one or more turns inside the respective bearer part and come out of the structure essentially from the first end or from the second end of the travelling cable.

7. The travelling cable according to claim 1, wherein at least one of the one or more optical fibers is a Fabry-Perot-type sensor fiber for the condition monitoring of the respective bearer part.

8. The travelling cable according to claim 1, wherein at least one of the one or more optical fibers is a sensor fiber, comprising a Bragg grating structure for the condition monitoring of the respective bearer part.

9. The travelling cable according to claim 1, wherein at least one of the one or more optical fibers is a sensor fiber, which functions as a Brillouin distributed fiber sensor for the condition monitoring of the respective bearer part.

10. The travelling cable according to claim 1, wherein at least one of the one or more optical fibers is a sensor fiber, in which fiber the time-of-flight of a light pulse is measured for the condition monitoring of the respective bearer part.

11. The travelling cable according to claim 1, wherein the one or more optical fibers is in the form of a fiber bundle, and wherein the fiber bundle extends inside the respective composite structure essentially from the first end of the travelling cable and comes out essentially from the second end of the travelling cable, or makes one or more turns inside the respective bearer part and comes out of the structure essentially from the first end or from the second end of the travelling cable.

12. The travelling cable according to claim 1, wherein the travelling cable is round in cross-section shape.

13. An elevator, comprising:

an elevator car;

a counterweight;

one or more suspension ropes including a load-bearing composite part, the load bearing composite part including reinforcing fibers in a polymer matrix, the one or more suspension ropes connecting the elevator car and the counterweight to each other; and a mechanism configured to move the elevator car and/or the counterweight, the mechanism comprising a hoisting machine configured to move the suspension roping, wherein the elevator includes the travelling cable according to claim 1 for transmitting electrical energy and data between the elevator car and the elevator hoistway.

14. The elevator according to claim 13, wherein the elevator includes a mechanism configured to monitor the condition of the at least one bearer part which includes the one or more optical fibers by monitoring changes that have occurred in an optical property of the one or more optical fibers.

15. The elevator according to claim 13, wherein the travelling cable includes a mechanism configured to monitor the condition of the at least one bearer part that includes one or more optical fibers by monitoring changes that have occurred in an electrical property of the respective bearer part.

16. An elevator, comprising:

an elevator car;

a counterweight;

one or more suspension ropes including a load-bearing composite part, the load bearing composite part including reinforcing fibers in a polymer matrix, the one or more suspension ropes connecting the elevator car and the counterweight to each other; and a mechanism configured to move the elevator car and/or the counterweight, the mechanism comprising a hoisting machine configured to move the suspension roping and including a rotating device and a traction device to be rotated, wherein the elevator includes the travelling cable according to claim 1 for transmitting electrical energy and data between the elevator car and the elevator hoistway.

* * * * *